United States Patent [19]

Petiau

[11] 4,209,162

[45] Jun. 24, 1980

[54] ANTI-SPLASH DEVICE

[75] Inventor: Raymond H. Petiau, Nancy, France

[73] Assignee: Agence Nationale de Valorization de la Recherce, France

[21] Appl. No.: 870,125

[22] Filed: Jan. 17, 1978

Related U.S. Application Data

[63] Continuation-in-part of Ser. No. 736,131, Oct. 27, 1976, abandoned.

[30] Foreign Application Priority Data

Oct. 28, 1975 [FR] France ..... 75 32926
Jan. 20, 1977 [FR] France ..... 77 01536

[51] Int. Cl.[2] ..... B22D 7/12

[52] U.S. Cl. ..... 249/206; 93/1 H; 93/1 WZ; 93/37 R; 93/86; 164/357; 164/362; 164/412; 266/287; 428/4; 428/9; 428/12; 428/116; 428/117; 428/118; D11/121; D11/125; D11/142

[58] Field of Search ..... 249/206; 164/357, 362, 164/412; 266/287; 93/1 H, 1 WZ, 37 R, 86; 428/4, 9, 12, 116, 117, 118; D11/121, 125, 142

[56] References Cited

U.S. PATENT DOCUMENTS 2,973,294 2/1961 McClelland ..... 428/116
3,170,831 2/1965 Paige ..... 428/9

FOREIGN PATENT DOCUMENTS 843136 7/1952 Fed. Rep. of Germany ..... 249/206

*Primary Examiner*—Lester L. Lee
*Attorney, Agent, or Firm*—Robert E. Burns; Emmanuel J. Lobato; Bruce L. Adams

[57] ABSTRACT

A device for mitigating the splashing of droplets of molten metal during the pouring of same into a mould comprises a strip or strips of material which form a system of polygonal cells. The device is for vertical location with the strips edgewise in the base of a mould and fulfills the function of either a splash-guard when casting direct or a float when bottom-casting.

9 Claims, 18 Drawing Figures

Fig. 1
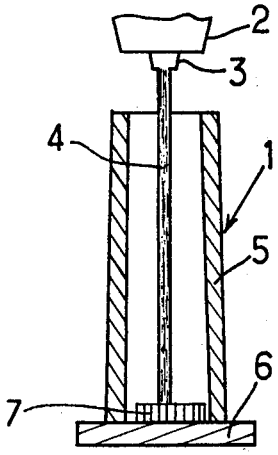
Fig. 3
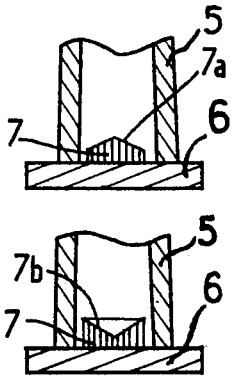
Fig. 5
Fig. 10
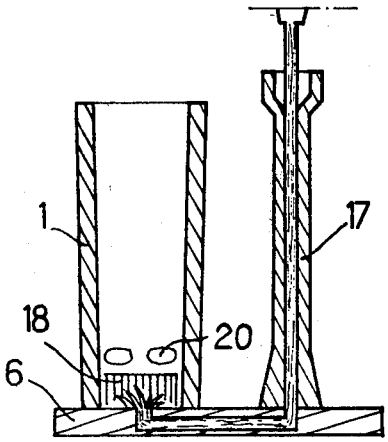
Fig. 11
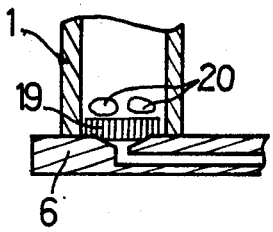

ANTI-SPLASH DEVICE

CROSS REFERENCE TO RELATED APPLICATION

This application is a Continuation-in-Part of my prior copending application Ser. No. 736,131 filed on Oct. 27, 1976 and now abandoned.

BACKGROUND OF THE INVENTION

The present invention relates to a device limiting the splashing of droplets of molten steel when pouring metal into an ingot-mould.

When the steel is cast directly in a stream, a device known as a "splash-guard" is usually placed at the bottom of the ingot-mould. When the steel is "bottom-cast", a "cushion" or "float" is used to support the casting adjuvants. The function of these devices is to eliminate splashing of droplets of molten steel on the cold walls of the ingot-mould, in contact with which these droplets solidify and ultimately cause the appearance of surface defects in the ingot or finished product.

At the time of direct casting in a stream, these devices also make it possible to reduce the impact of the stream of steel against the base of the ingot-mould and consequently to reduce wear of the latter.

They also contribute to reducing the sudden cooling of steel coming into contact with the mass of the ingot-mould through the intermediary of its base, thus causing "bottle bottom" shrinkage of the ingot.

Various devices of this type are already known, in particular splash-guards produced from a strip of corrugated cardboard wound in a spiral. However, these devices are not completely satisfactory since they have a relatively high cost price, are difficult to use and have a limited efficiency.

SUMMARY OF THE INVENTION

The essential object of the present invention is to remedy these drawbacks.

To this end, this device for limiting the splashing of droplets of molten steel at the time of pouring metal into an ingot-mould, placed on the bottom of the latter, before pouring and fulfilling the function of a splash-guard at the time of direct pouring in the form of a stream or of a float at the time of bottom-casting, comprising at least one vertical strip placed edgewise on the base of the ingot-mould, is characterised in that the splash-guard or float device is constituted by an expandable rosette of substantially radially extending strips delimiting adjacent cells and having a greater wall density at the center of the rosette than at the periphery.

The splash-guard or float device according to the invention may be made in any appropriate shape, namely cylindrical having a circular or oval cross-section, or even prismatic having a polygonal section. The strip or strips constituting the splash-guard device may be made from cardboard or advantageously of other less inflammable or fire-proof material, as will be described hereinafter. In particular, the device may be made from a refractory material increasing the thermal insulation between the steel and the base of the ingot-mould.

The splash-guard or float device according to the invention may be supplied in a compact form, representing a volume equal to approximately one twentieth of the final volume of the device when in use and it may be assembled rapidly before being used.

In practice, these splash-guards are placed at the base of an ingot-mould, the height of which may reach three meters. Now at the time of the impact on the base of the ingot-mould, it may happen that the splash-guard device in the shape of a rosette closes-up thus firstly forming a cone, then a cylinder whose height corresponds to the radius of the initial rosette.

Attempts have been made to remedy this drawback by sticking a square of strong paper on each side of the rosette, these two squares keeping the rosette rigid in its open position. However, this sticking operation requires a certain period of time, which constitues an indisputable drawback.

Another object of the present invention is to remedy this drawback by providing a splash-guard device which can be opened out very quickly in the form of a rosette and held in the open position without the addition of any reinforcing member.

To this end, this device known as a "splash-guard for an ingot-mould" making it possible to limit the splashing of droplets of molten steel at the time of casting in an ingot-mould, placed at the bottom of the latter, this device being constituted by sheets of cardboard or similar material arranged in the form of a rosette and able to be opened out prior to its use by opening the latter in the manner of a fan, in order to increase the density at the centre of the rosette, is characterised in that the ends of the sheets nearest the centre of the open rosette are stuck to each other by means of an adhesive which remains flexible after setting, in order to form at the centre of the open rosette, a central cylinder of small diameter contributing to keeping the open rosette rigid.

Another object of the invention is to provide a reliable method of connecting two sheets constituting the end faces of the rosette which are located side-by-side when the rosette is opened out.

Actually, these two end sheets may be firmly connected by clipping or by self-adhesive means but it has been found that certain self-adhesive glues lost their quality under the effect of an excessively low or high temperature, as may occur in a steel works.

To remedy this drawback, the present invention also ensures the connection of the end faces of the opened rosette by means of one or more metal or plastic press-studs whereof the male part is fixed to one of the end faces and the female part is fixed to the other end face, in positions such that these two parts are able to co-operate when the two end faces are placed side-by-side.

It will be understood that this method of connection is very easy to implement and furthermore that it is completely independent of temperature variations.

According to the invention, in order to keep the rosette opened out, it is also possible to use any other form of self-adhesive tape, placed on the end faces of the rosette, or even a magnetic elastomer keeping the two end faces stuck together by magnetic attraction.

One limitation in the use of known splash-guard devices in ingot-moulds has been introduced owing to the fact that in ingot-moulds having a fixed base plate, the latter cannot cool between two successive casting operations. Consequently, cardboard splash-guard devices which are placed in the bottom of ingot-moulds may burst into flame before the steel is cast. Attemps have been made to remedy this drawback by impregnating these splash-guard devices with sodium silicate. However, for certain qualities of steel, it is absolutely prohibited to introduce sodium silicate into the ingot-mould.

The present invention also relates to another improvement making it possible to eliminate the aforesaid use of sodium silicate despite the presence of a base plate which is too hot and whilst preserving the possibility of the splash-guard device being expanded rapidly at the place of use.

To this end, the splash-guard device for an ingot-mould according to the invention is characterised in that it is constituted by at least two superimposed basic rosettes, whereof the lower rosette is constituted by a non-inflammable material, for example non-inflammable cardboard. To facilitate the expansion of the final rosette constituted by the two basic rosettes, in a single operation, by opening out cellular systems by rotating them through 360° in the manner of a fan, the two basic superimposed rosettes are previously connected by sticking a vertical sheet of light card, or other similar material, to each of the end faces intended to pivot by rotation about the central part which is immobilised by means of the flexible adhesive.

A splash-guard device of this type according to the invention may be used in all cases where the base plate of the ingot-mould is too hot and where the use of sodium silicate is prohibited, without having to use a splash-guard device made entirely from non-inflammable cardboard, which is very expensive.

Various embodiments of the present invention will be described hereafter as non-limiting examples, with reference to the accompanying drawings:

BRIEF DESCRIPTION OF THE DRAWINGS

FIG. 1 is a diagrammatic vertical sectional view of an ingot-mould provided with a splash-guard according to the invention, at the time of casting.

FIG. 3 is a partial vertical sectional view of the lower part of a modified ingot-mould in which a splash-guard device in the form of a rosette, having an upper conical surface, is placed.

FIG. 5 is a partial vertical sectional view of another embodiment of an ingot-mould in which a splash-guard device in the shape of a rosette, having an upper surface constituted by a conical cup is housed.

FIG. 10 is a diagrammatic vertical sectional view of an ingot-mould used for bottom-casting and in which a device according to the invention constituting a float is located.

FIG. 11 is a partial sectional view of the ingot-mould of FIG. 10, in which a variation of the device forming the float is located.

DESCRIPTION OF THE PREFERED EMBODIMENTS

Figure 2:
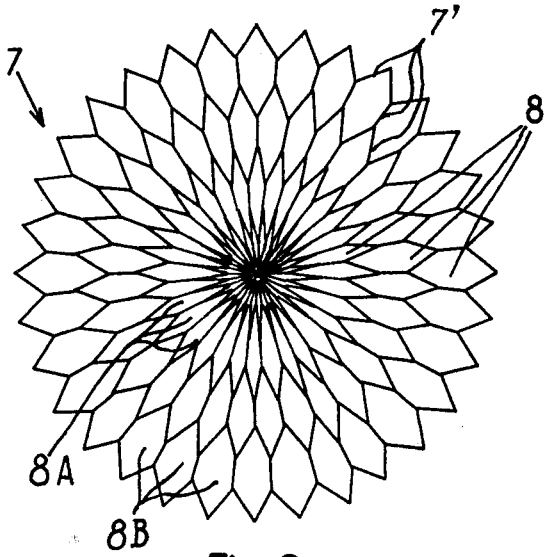
FIG. 2 is a plan view of the splash-guard device in the form of a rosette.
Figure 4:
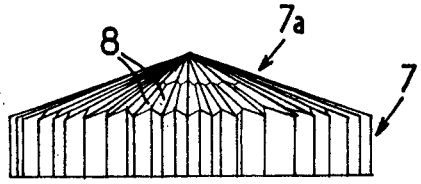
FIG. 4 is an elevational view of the splash-guard device in the form of a rosette having an upper conical surface.

FIG. 1 shows diagrammatically an ingot-mould 1, above which is located a casting ladle 2 comprising a nozzle 3 having a slide valve, from which a stream of molten metal 4 flows along the axis of the mould. The ingot-mould 1 comprises two parts, namely a conical cast iron side wall of the mould 5, open at the top and bottom, and a base 6 constituted by a strong cast iron plate and on which the mould wall 1 rests. A device 7 constituting a splash-guard for the ingot-mould is placed on the base 6 and the stream of molten metal 4 strikes the centre of the splash-guard. This splash-guard device 7 is mainly intended to prevent droplets of molten steel from splashing towards the cold wall of the ingot-mould constituted by the conical mould 5.

According to the invention, the splash-guard device 7, which may be constructed in one of the shapes illustrated in FIGS. 2 to 18, is formed from laterally interconnected strips 7' of a combustible or non-combustible material, such as cardboard, which as shown stand edgewise on the base 6 of the ingot-mould 1. The strip or strips illustrated consituting the splash-guard device 7 define a substantially polygonal system of concentric rings of cells 8 (FIG. 2). Due to this, the stream of steel 4 which falls mainly on the central part of the splash-guard device 7 is in practice not able to splash out towards the cold side wall of the ingot-mould 1, owing to the presence of the strips placed edgewise and thus forming screens.

The splash-guard device according to the invention may be made in the form of a rosette, as illustrated in FIG. 2. In this case, the density of the cells 8 decreases from the cells 8A of the innermostring of cells of the rosette towards the outermostring of cells 8B. In other words, the walls of the various cells are very close to each other at the centre of the rosette and are less so on approaching the periphery. In the illustrated embodiment, the cells have a hexagonal shape but they could naturally be of any other polygonal shape.

Each cell 8, and mainly each cell in the inner ring or area of cells 8A, is elongate along an axis disposed radially of the rosette; as shown the outer cells 8B are wider and relatively less elongate than the inner ones.

The splash-guard device 7 may have a curved, circular or oval periphery, as will be seen hereafter, or a polygonal periphery. Its front sides may both be flat or its upper side 7a may be conical, as shown in FIGS. 3 and 4. In this way, it is possible to increase the depth of the splash-guard device 7 at the centre of the rosette, for the same weight of cardboard. This arrangement is particularly advantageous, because in practice the vertical stream of steel diverges from the centre of the base of the ingot-mould by only several centimeters. Consequently, the action of the splash-guard device 7 in preventing the splashing of steel droplets mainly occurs at the centre and it is thus advantageous to increase the depth of the latter at this point.

According to one variation, illustrated in FIG. 5, the splash-guard device 7 has a hollow upper surface 7b, in the shape of a conical cup. In this case, the splash-guard device 7 also fulfils the function of a "flaw-guard" preventing molten droplets from solidifying on the wall 5 of the ingot-mould 1.

Figure 6:
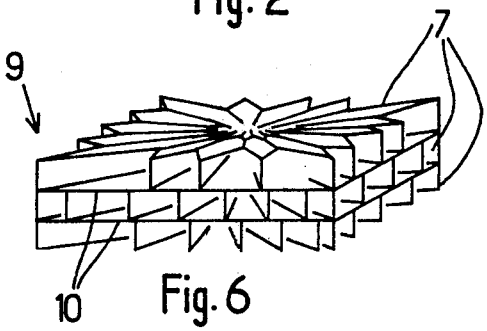
FIG. 6 is a perspective view of a variation of a splash-guard device constituted by placing several rosettes one above the other.

In the variation illustrated in FIG. 6, the splash-guard device 9 according to the invention is constituted by superimposing several basic splash-guard devices 7 in the form of a rosette (three in number in the examples shown), connected by interposed sheets 10 provided with adhesive. This increases the probability of the stream of molten steel encountering vertical strips. In this application, the basic splash-guards 7 may also be constituted by a system of cells of equal cross-section.

Figure 7:
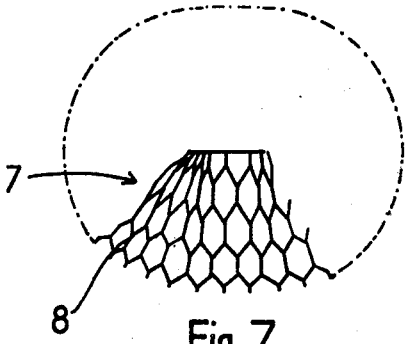
FIG. 7 is a partial diagrammatic plan view of an oval splash-guard device in the form of a rosette.

The splash-guard device shown diagrammatically in FIG. 7 is of oval shape. By sawing or cutting the sides of the splash-guard device in the shape of a rosette or oval or of a large panel obtained as above-described, it is possible to obtain square or rectangular splash-guards having straight or truncated corners.

Figure 8:
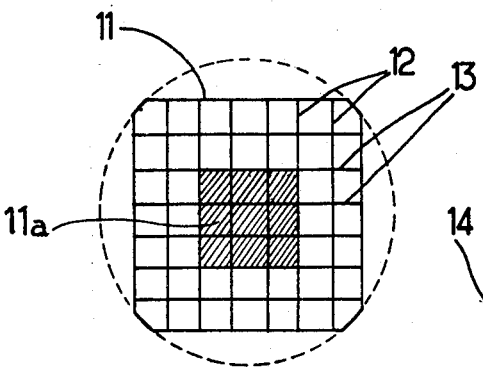
FIG. 8 is a diagrammatic plan view of a square splash-guard device, having truncated corners, constituted by a system of square cells.

FIG. 8 shows diagrammatically a splash-guard device 11 having a square cross-section with truncated corners. In this particular embodiment, the splash-guard device 11 is constituted by two sets of parallel strips 12 and 13, at right-angles to each other, in order to define a system of square or rectangular cells. The mesh of this system, i.e. the density of the cells, is shown constant over the entire surface of the splash-guard device 11, in FIG. 8, but can be made to decrease from the centre of the device 11 towards the periphery, as in the case of the rosette in FIG. 2, by longitudinally drawing-out the system.

The centre of the splash-guard can be reinforced by inserting in the lower part, either a metal plate, particles of wood or compact cardboard, or a block of the "honeycomb" system wherein the axes of the cells are horizontal, or a block of multi-layer corrugated cardboard. Such a plate or block is shown diagrammatically in the shaded region 11a in FIG. 8.

The splash-guard device according to the invention may be obtained from a structure of the "honeycomb" type. This "honeycomb" structure may be expanded in a circle by complete rotation of one end about the other end serving as a fixed point, according to the principle of a fan. Once the splash-guard device has been deployed, it may be maintained in this position by clipping pairs of mutually adjacent sides or sticking them together by means of interposed bodies of an appropriate adhesive. In this case, the splash-guard device developed in the shape of a fan occupies a volume equal to approximately twenty times the non-expanded volume (see FIG. 7 where cells at right and left are in process of being deployed).

In this latter embodiment, in order to reduce transportation costs and the storage space required, the splash-guard device according to the invention may be delivered in the unexpanded form. In this case, the outer sides which have to be brought together and stuck after opening out in the fan shape, are provided with contact adhesive protected by a film which can be easily removed.

Figure 9:
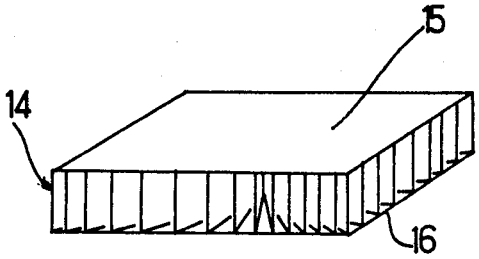
FIG. 9 is a perspective view of a variation of a splash-guard device in the form of a rosette, provided with facings.

In the embodiment illustrated in FIG. 9, the splash-guard device 14, which may be of the rosette type of FIG. 2 or the matrix of FIG. 8, comprises facings 15, 16 stuck to two sides of the splash-guard device 14, which is thus sandwiched. In practice, to provide good rigidity of the splash-guards or cushions according to the present invention, paper facings of approximately 10 cm×10 cm are stuck on each side to the central part. When the splash-guard is conical or concave, the paper square is split from one edge to the centre in order to fit the cone or cup-shape.

When using a splash-guard in the form of a rosette 7 or having a non-homogeneous rectangular mesh, i.e. a mesh decreasing from the centre towards the periphery, the lower central part may also be reinforced, for example as described above for FIG. 8, by the adhesion of a metal sheet or wood particles forming a lower facing.

In order to decrease the inflammability of the splash-guard device, or even make the latter fireproof, various materials may be used in place of cardboard, such as steel, a cardboard/steel complex, asbestos, an asbestos/steel complex, a steel/glass cloth complex. These materials are made into a splash-guard according to the same methods as for the cardboard strips of a cellular structure of the "honeycomb" type.

An effective thermal screen retarding the transmission of heat between the molten steel at the base 6 of the ingot-mould is obtained by using inserted sheets or facings, such as the sheets 10 in the embodiment of FIG. 6 and the sheets 15 and 16 in the case of FIG. 9. These inserted sheets or facings are made from slightly inflammable, non-combustible or refractory material, such as steel, aluminium, asbestos or a silica/alumina complex. A single sheet, such as the sheet 16 may be used as the lower facing of the splash-guard device. In fact, since this sheet is in direct contact with the base of the ingot-mould, it withstands the impact of the stream of molten steel better and for a longer period of time.

FIG. 10 illustrates the use of the device according to the invention in the case of bottom-casting. In this case, the metal penetrates the ingot-mould 1 from the centre of the base plate constituting the base of the ingot-mould and where a nozzle of refractory material has been located. Pouring takes place in an adjacent column 17 whose inner volume is connected to the orifice provided in the centre of the base plate 6. In this case, a splash-guard device 18 is placed on the base of the ingot-mould 1, which device is intended to fulfil the function of a cushion or float rising on the surface of the steel, as the level of the latter rises in the ingot-mould 1, during casting. Located above this float 18 are bags 20 of insulating powdered products. In this case, the device 18 according to the invention, constituting a float, advantageously comprises a conical or concave lower surface, i.e. of lesser depth at the centre at the point where the stream of molten steel escapes.

In the case illustrated in FIG. 11, the base plate comprises a central conical recess. The splash-guard device 19 is in the shape of an inverted truncated cone in order to fit this conical recess.

The splash-guard device according to the invention may be used in all ingot-moulds, for direct casting using gravity of the molten steel, or bottom-casting. It is clearly more efficient than the splash-guard devices currently on the market. It may be adapted to all shapes of ingot-mould and may be assembled at the point of use in order to reduce transportation and storage costs.

Figure 12:
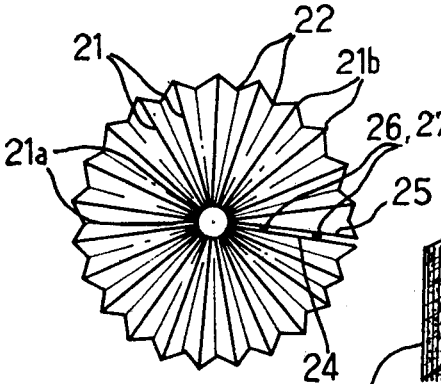
FIG. 12 is a diagrammatic plan view of a splash-guard device for an ingot-mould constituted by an arrangement of sheets placed radially and opened out to form a rosette.

In the embodiment illustrated in FIG. 12, the splash-guard device constitutes a rosette formed by a certain number of radial sheets 21 of cardboard or similar material, which are opened out over an arc of 360° in the manner of a fan. These radial sheets 21 adjoin each other and comprise intermediate folds 22 forming dihedrons open at the top and bottom and defining radial and horizontal cells, the width of these dihedrons increasing from the centre towards the periphery, such that the density of the rosette is greater at the centre.

According to the invention, the ends $21_a$ of the sheets 21 which are closest to the centre of the open rosette, are stuck to each other by means of an adhesive which remains flexible after it has set. In this way, after opening out the rosette, these ends $21_a$ form a central cylinder of small diameter, which contributes to keeping the arrangement of the open rosette rigid.

Figure 13:
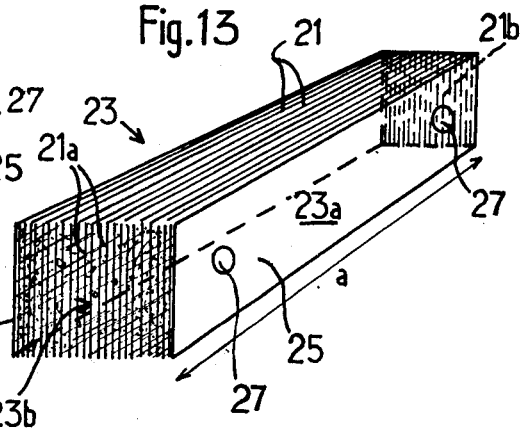
FIG. 13 is a perspective view of the splash-guard device, in the folded position.

In the folded state, which is suitable for transportation and storage, the splash-guard device has the appearance of a parallelepipedal block 23, as shown in FIG. 13, this block being constituted by the various constituent sheets 21 placed one against the other. The largest dimension a of the parallelepipedal block 23 corresponds substantially to the radius of the open rosette, as shown in FIG. 12, reduced by the radius of the small central cylinder formed by the inner ends 21*a* of the sheets 21. The sheets of cardboard 21 which are stuck together are located in planes parallel to the side face 23*a* of the block 23. One of the front sides 23*b* of the block 23 in which all the ends 21*a* of the sheets 21 are located, is coated with a special adhesive for connecting the latter. For this purpose, it is possible to use an adhesive having the feature of remaining flexible after setting, for example the adhesive known commercially by the name Planaxol.

Figure 14:
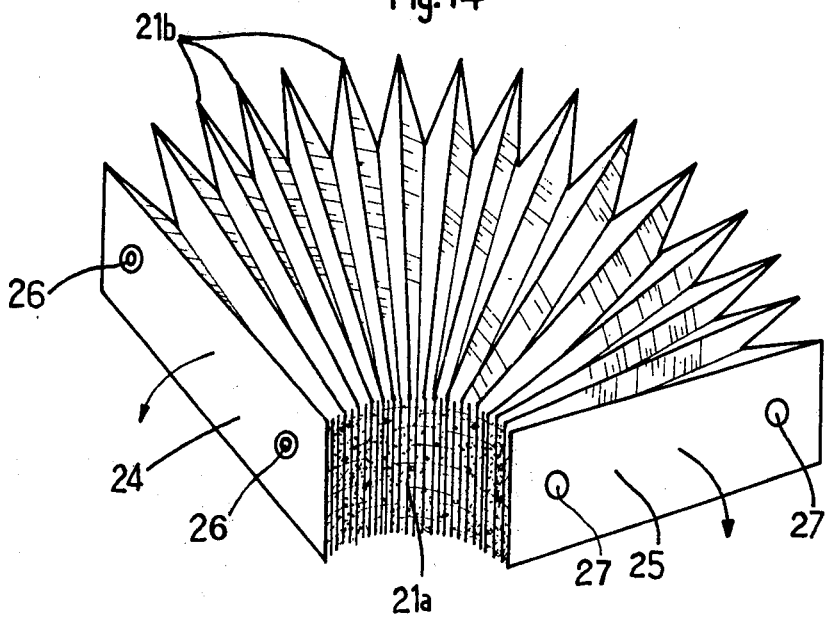
FIG. 14 is a perspective view of the splash-guard device in the form of a rosette during the opening operation.
Figure 15:
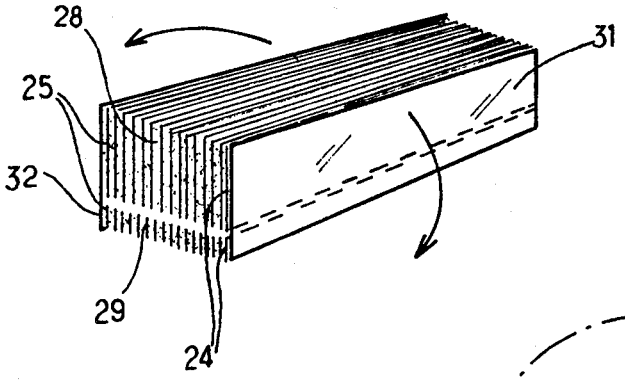
FIG. 15 is a perspective view of a variation of the splash-guard device, in the folded position, comprising two superimposed rosettes.

The other front face of the block 23, i.e. that opposite the front face 23*b* is not coated with adhesive. This face comprises the other outer ends 21*b* of the various sheets 21 constituting the block 23. Consequently, when these outer ends 21*b* are separated from each other as illustrated in FIG. 14, the rosette is opened out progressively, the radial sheets 21 of which pivot about their inner ends 21*a* interconnected by the layer of flexible adhesive.

After complete opening of the rosette through 360° (FIG. 12), the two ends sheets 24 and 25 are fixed one to the other, when the latter are side-by-side.

FIG. 12 shows that when the rosette is opened out, the front side 23*b* of the initial block 23 coated with adhesive forms a cylinder of small diameter at the centre of the rosette. The flexible adhesive ensuring the connection of the ends 21*a* of the sheets 21 does not constitute a hindrance to opening out these sheets. Since the latter are connected to each other at the centre of the rosette, the latter is absolutely rigid and cannot be deformed.

The connection of the end faces 24 and 25 may take place by sticking or clipping. However, according to the invention, the connection is preferably provided by means of metal or plastic press-studs. To this end, the female part 26 of one or more press-studs is riveted in one of the end sheets 24 and in the same manner the corresponding male part 27 of the press-stud is riveted in a similar way in the other end sheet 25 and at the same distance from the centre of the rosette. Consequently, once the rosette has been opened out and the two end faces pressed one against the other, it is sufficient to engage the male part 27 of the press-stud in the female part 26 to ensure a permanent connection of the two faces whatever the temperature variations. Consequently, there is no danger of the open rosette re-closing inopportunely as a result of interruption of the connection between the end faces 24 and 25.

According to one variation, the connection between the end faces 24 and 25 may be produced by means of any self-adhesive strip. A magnetic elastomer may also be used to this end, keeping the two end faces 24 and 25 pressed one against the other by magnetic attraction.

If the splash-guard device according to the invention is used in an ingot-mould having a fixed base plate which is not able to cool between two casting operations and may consequently cause the premature combustion of the splash-guard device, the latter is advantageously made in the form of two superimposed rosettes 28, 29, whereof the rosette 29, i.e. that which is intended to come into contact with the base plate of the ingot-mould, is made from non-inflammable material, for example non-inflammable cardboard. Consequently, one obtains a splash-guard device which is made non-inflammable without having to use sodium silicate, which may be prohibited in the case of certain steels.

This splash-guard device also has the advantage of being much less expensive than if it were made completely from non-inflammable cardboard.

The lower rosette 29, which is made from non-inflammable cardboard, is preferably shallower than the upper rosette made from ordinary cardboard.

To facilitate the expansion of the composite rosette, constituted by two superimposed basic rosettes, in a single operation by opening out the radial sheets 21 in the manner of a fan, the two folded and superimposed rosettes 28, 29, in the form of two parallelepipedal blocks, are previously connected by sticking a vertical sheet 31, 32 of light-weight cardboard on each pair of superimposed end faces 24 or 25 of the two blocks 28 and 29. The two vertical sheets 31, 32, ensuring the connection of the superimposed end faces may in turn have self-adhesive properties in order to stick firmly one to the other, when the composite rosette is completely opened out. They may also comprise rapid attachment members, such as press-studs.

Although, in the embodiments of the invention which were described with reference to FIGS. 12 to 15, the cells of the open rosette constituting the splash-guard device extend radially and horizontally, the invention naturally also applies to the case where these cells have a different orientation.

Figure 16:
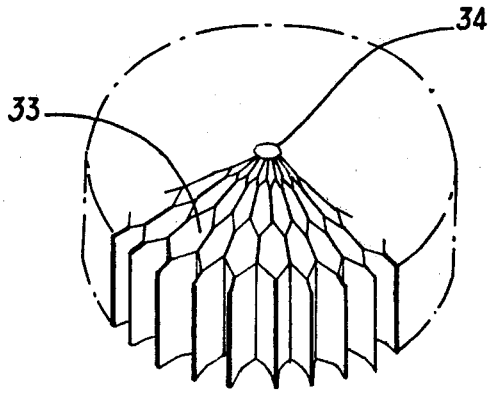
FIG. 16 is a partial perspective view of an open rosette comprising vertical cells.

By way of example, FIG. 16 shows an open rosette wherein the cells 33 in the form of a honeycomb extend vertically, in other words parallel to the axis of the rosette. Each cell 33 is defined by a prism of hexagonal cross section and these cells are flatter the closer they are located to the central part of the rosette where the ends of the individual sheets constituting the latter are once more stuck together by means of a flexible adhesive in order to form a central cylinder 34 of small diameter.

Figure 17:
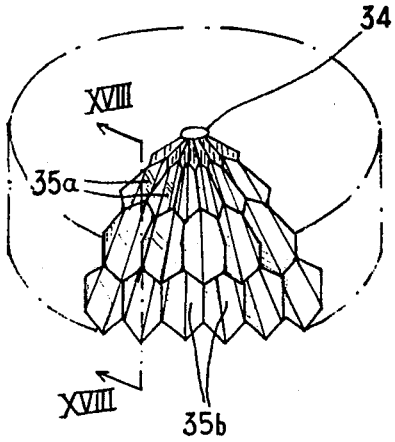
FIG. 17 is a partial perspective view of an opened rosette comprising cells whose axes are inclined with respect to the axis of the rosette.
Figure 18:
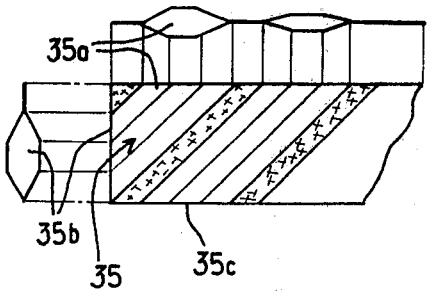
FIG. 18 is a view in partial radial section taken on the radial plane XVIII—XVIII of FIG. 17.

In the variation illustrated in FIGS. 17 and 18, the open rosette constituting the splash-guard device comprises cells 35 defined by prisms of hexagonal cross section whose axes are inclined with respect to the axis of the rosette, for example by an angle of approximately 45°. Consequently, each of the cells 35 opens out on the upper surface of the rosette by an orifice 35*a* and also either in the lateral surface of this rosette by another orifice 35*b* or in the lower surface by an orifice 35*c*. The upper and horizontal orifices 35*a* have flatter hexagonal shapes the closer they are to the centre.

This inclined arrangement of the cells 35 is particularly advantageous, since the walls of the cells prevent possible splashing of droplets of steel striking the bottom of the ingot-mould at high speed.

In all embodiments of the invention, the open rosette constituting the splash-guard device may be provided on its lower side with a sheet of cardboard treated with silicate constituting a member for retarding combustion. In this respect, it should be noted that the open rosette comprising radial and horizontal cells, as illustrated in FIGS. 12 to 14, is consumed less easily than that comprising vertical cells (FIG. 5) owing to the fact that in the latter case, the vertical edges constituting the lateral surface of the rosette in some way define conduction passageways facilitating the combustion of the rosette.

What is claimed is:

1. An anti-splash device for an ingot-mould, making it possible to limit the splashing of droplets of molten steel at the time of casting in an ingot-mould, placed in the bottom of the latter, this device being constituted by sheets of cardboard or similar material, arranged in the form of a rosette which can be opened out prior to its use by opening the latter in the manner of a fan, in order to increase the density at the centre of the rosette, the ends of the sheets closest to the centre of the open rosette being stuck to each other by means of an adhesive which remains flexible after setting, in order to form a central cylinder of small diameter, at the centre of the open rosette, which cylinder contributes to keeping the arrangement of the open rosette rigid.

2. A device according to claim 1, comprising at least one press-stud whereof the male part is fixed to one of the end faces of the open rosette and the female part to the other end face of said rosette, in positions such that these parts are able to co-operate when the two end faces of the rosette are placed side-by-side for connecting the end faces of the open rosette.

3. A device according to claim 1, comprising a self-adhesive strip or magnetic elastomer for connecting the end faces of the open rosette.

4. A device according to claim 1, comprising at least two superimposed basic rosettes whereof the lower rosette, intended to come into contact with the base plate of the ingot-mould, is made of non-inflammable sheet material.

5. A device according to claim 4, wherein the lower basic rosette is shallower than the upper rosette.

6. A device according to claim 4, comprising a vertical sheet of light cardboard sticked to each pair of superimposed end faces for interconnecting the end faces of the two superimposed basic rosettes.

7. A device according to claim 1, wherein the sheets of the rosette define vertical cells constituted by prisms having a hexagonal cross section, which are increasingly flat towards the centre of the rosette.

8. A device according to claim 1, wherein the sheets of the rosette define cells constituted by prisms having a hexagonal cross section, whose axes are inclined with respect to the vertical axis of the rosette and which open out on the upper side of the rosette and either in the side face or in the lower face of this rosette.

9. A device according to claim 1, wherein the sheets of the rosette form radial and horizontal dihedrons, which open at the top and bottom and define cells extending radially and horizontally, the width of the dihedrons increasing from the centre towards the periphery.

* * * * *